US006802395B1

(12) United States Patent
Helstrom et al.

(10) Patent No.: US 6,802,395 B1
(45) Date of Patent: Oct. 12, 2004

(54) SYSTEM FOR CONTROL AND DECELERATION OF ELEVATOR DURING EMERGENCY BRAKING

(75) Inventors: Brad Helstrom, McKinney, TX (US); Don Afman, Moline, IL (US); John Weber, Milan, IL (US)

(73) Assignee: Kone Corporation, Hyvinkaa (FI)

( * ) Notice: Subject to any disclaimer, the term of this patent is extended or adjusted under 35 U.S.C. 154(b) by 0 days.

(21) Appl. No.: 10/400,568

(22) Filed: Mar. 28, 2003

(51) Int. Cl.[7] ..... B66B 1/32
(52) U.S. Cl. ..... 187/288; 187/247
(58) Field of Search ..... 187/314, 316, 187/277, 281, 288, 291, 293, 287, 290, 351, 247

(56) References Cited

U.S. PATENT DOCUMENTS 3,743,055 A 7/1973 Hoelscher et al.
3,779,346 A * 12/1973 Winkler ..... 187/294
4,220,221 A 9/1980 Gingrich
4,567,419 A * 1/1986 Watanabe ..... 318/798
4,570,755 A 2/1986 Tsai et al.
5,241,141 A * 8/1993 Cominelli ..... 187/295
5,244,060 A * 9/1993 Tanaka et al. ..... 187/261
5,323,878 A * 6/1994 Nakamura et al. ..... 187/264
5,402,863 A * 4/1995 Okumura et al. ..... 187/288
5,637,841 A * 6/1997 Dugan et al. ..... 187/294
5,648,644 A * 7/1997 Nagel ..... 187/288
5,877,462 A * 3/1999 Chenais ..... 187/249
5,893,432 A * 4/1999 Nguyen et al. ..... 187/290
6,170,614 B1 * 1/2001 Herkel et al. ..... 187/287
2003/0111306 A1 * 6/2003 Watanabe et al. ..... 188/180

* cited by examiner

*Primary Examiner*—Jonathan Salata
(74) *Attorney, Agent, or Firm*—Birch, Stewart, Kolasch & Birch, LLP

(57) ABSTRACT

A system for controlling the braking of an elevator car during an emergency. When there is a power failure or other emergency, a brake is applied to slow the elevator car to a stop in a controlled fashion. By Controlling the braking, the car is stopped in a short time but without discomfort to the passengers. The controller receives inputs from the rope movement, motor movement, temperature and the braking current to correctly determine the amount of braking which should be applied.

19 Claims, 2 Drawing Sheets

SYSTEM FOR CONTROL AND DECELERATION OF ELEVATOR DURING EMERGENCY BRAKING

BACKGROUND OF THE INVENTION

1. Field of the Invention

The present invention relates generally to a braking system for an elevator and more particularly to the system to control the deceleration of an elevator during an emergency braking condition.

2. Description of the Background Art

Modern elevator systems are among the safest modes of travel and normally provide smooth and comfortable rides for its passengers. Furthermore, computerized control system currently available provide the cars with a gentle landing at the selected floors so as to avoid the uncomfortable feeling of sudden deceleration and jerkiness.

Various devices have been configured to control the motor drive of the elevator so that the movement of the car is smooth and comfortable for the passengers. U.S. Pat. No. 4,570,755 shows a computer which controls the movement of an elevator car during the final several inches of travel approaching a selected floor. Similarly, U.S. Pat. No. 4,220,221 shows a system for controlling the velocity of the vehicle so that it is stopped smoothly while being aligned with a desired floor. Likewise, U.S. Pat. No. 3,743,055 controls the acceleration and deceleration of an elevator car as it moves between floors.

These and other systems provide for gentle landings by controlling the motor when the elevator is in the normal operational mode. However, during an emergency situation, emergency braking systems are utilized to stop the elevator car. These emergencies may be due to a power failure, a broken safety chain or some other sensed

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
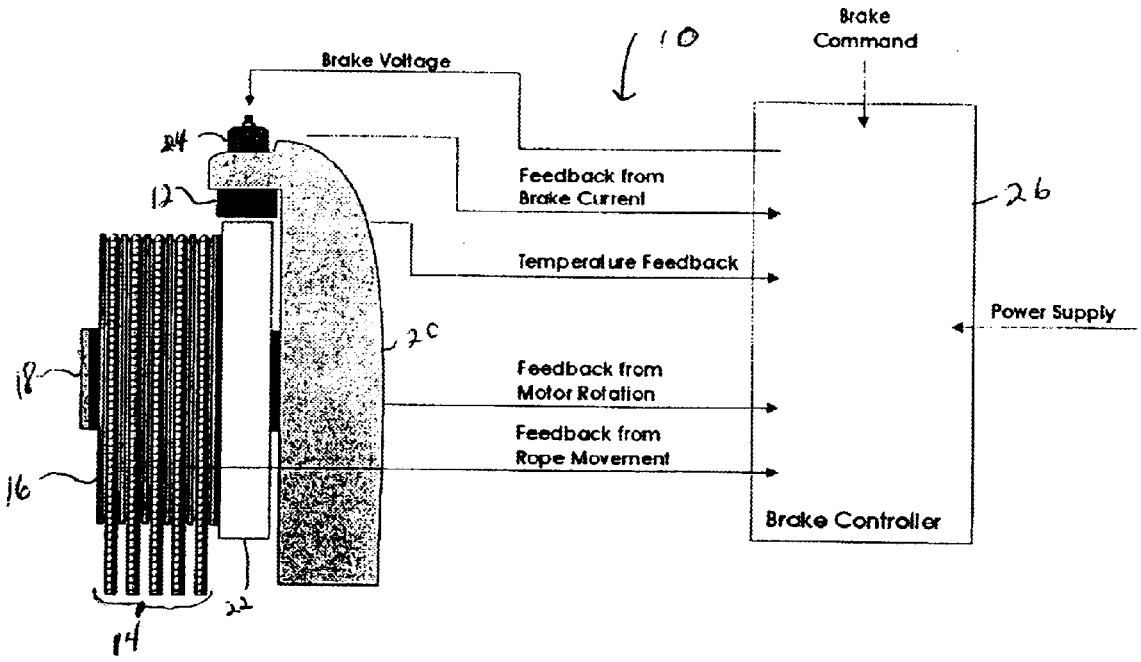
FIG. 1 is a block diagram of an embodiment of the present invention.

Referring now to drawings wherein like reference numerals designate identical or corresponding parts throughout the several views, and more particularly to FIG. 1 thereof, wherein a system 10 for controlling the brake 12 of an elevator system is shown. Cables 14 support the elevator car in a known fashion and are wound around a grooved wheel or sheave 16. This wheel is mounted on an axle 18 for rotation which is connected to a fixed support 20.

Also mounted on the axle is a braking surface 22 against which a brake 12 can be applied. This braking surface is fixedly connected to the wheel 16 so that when the brake is applied to the braking surface, the wheel is stopped along with cables 14. The brake 12 is forced against the braking surface 22 by way of a brake driver 24. In those systems where a gear box is present between the motor and axle 18, it may be preferable to mount the braking surface between the motor and gear box. However, the operation of the device is similar otherwise.

The brake driver 24 commonly includes a spring which pushes the brake 12 against the braking surface 22. A coil which is electrically activated retracts the brake against the spring when power is applied to the coil. During an emergency, power is removed from the coil so that the spring drives the brake pad against the braking surface.

The electrical signal controlling the brake driver 24 is generated in a brake controller 26. The brake controller receives a number of inputs which describe the situation existing in the elevator system at a given time. Thus, the power supply input indicates whether power is currently available to the system and thus indicates when a power failure occurs. Likewise, a brake command signal indicates that a sensor has determined an emergency situation, such as the breaking of a safety chain or sensing of a fire, so that the application of the brakes is desirable. The controller also receives a feedback from the brake driver to describe the brake current being applied. Also, the temperature of the brake is also fedback to the controller. Signals are also provided to indicate the amount of motor rotation and the cable movement. These various inputs are used by the controller to determine when the brake should be applied and also the rate of deceleration of the car for maximum efficiency, comfort and safety.

Figure 2:
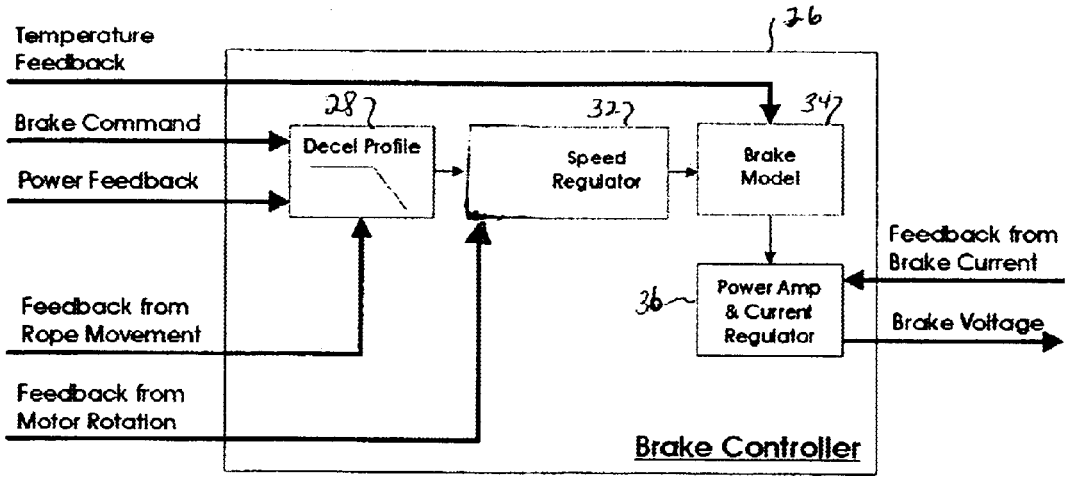
FIG. 2 is a block diagram of the brake controller of the embodiment shown in FIG. 1, FIGS. 3A and 3B are graphs showing the speed of an elevator car during an emergency braking procedure when using the prior art and the current invention, respectively.

FIG. 2 is a block diagram showing the internal circuitry of the brake controller 26. A deceleration profile device 28 stores the profile of a preferred emergency deceleration. This is a deceleration curve that provides a quick stop to the car yet does not provide discomfort to the passengers nor causes the cables to loose traction with the sheave. This desirable deceleration is compared to the feedback from the cable movement to determine whether the cable should move faster or slower. Since the cable is connected to the elevator car, this also indicates the movement of the car. It is also possible to include a different type of sensor which senses the position of the car rather than the movement of the cable. The deceleration profile device 28 then produces an output which indicates whether the car should be moving faster or slower.

The deceleration profile device 28 also receives inputs from the brake command and power feedback. The brake command indicates that an emergency has occurred as determined by a sensor. The power feedback indicates that a power failure has occurred. A signal on either of these lines indicates that the emergency brake controller 26 should begin to operate. In addition, the power feedback signal also indicates whether there is sufficient power available for the device to operate.

Once it has been determined that the speed of the car needs to be changed, the signal is sent from the deceleration profile device to the speed regulator 32. The feedback from the motor is also applied to the speed regulator. These two signals are combined to determine how much torque is needed for the brake to change the speed of the car. This torque relates to how much friction is needed to change the speed of the car. This determination depends on a number of parameters, including the load on the elevator, the spring tension in the brake driver and even such parameters as the amount of brake pad wear. It should be remembered that prior art emergency braking systems are basically binary, that is, they are either in the brake position or off position only. By determining the amount of torque that should be applied, the emergency brake controller 26 is able to provide a linear control to the emergency braking system. Accordingly, the speed regulator determines the amount of torque which the brake needs to apply.

Brake model 34 receives the signal indicating the amount of torque needed. The brake model stores information regarding the relationship between an amount of torque required and the current needed to cause this torque. This relates to the spring tension of the brake driver and other parameters of the braking system. The spring tension parameter is especially difficult since it is a highly non-linear function and often even discontinuous. Another parameter that is important is the temperature of the brake. A temperature feedback is applied to the brake model 34 in order to take account of this parameter as well. In some cases, it is preferable to not include a temperature feedback and the brake model 34 will operate in a similar fashion but without taking into account this parameter. The brake model 34 then produces an output which is a desired current necessary to produce the torque to appropriately slow the elevator car. This current signal is then applied to the power amplifier and current regulator 36.

This power amplifier, which is of a known type, receives the signal indicating the desired current and produces an output brake voltage which is applied to the brake driver. The voltage applied to the brake driver causes current to flow therein. The amount of current which flows is then sensed and fed back to the power amplifier. This feedback is compared to the desired current to control the brake voltage signal sent to the brake driver. It should be remembered that the voltage applied to the brake driver will be related to the current in accordance with the resistance and inductance of the coil.

Thus, the deceleration brake controller 26 receives a signal indicating that an emergency has occurred and compares the movement of the cable and hence the car, to a desired profile to determine a speed curve which is compared to the motor rotation in a speed regulator. The desired torque is then input to a brake model 30 which also receives a temperature feedback signal. The brake model 30 determines the desirable current which, when compared to the feed back of the brake current causes a brake voltage signal to be generated to the brake driver. Using this approach, it is possible to control the application of the brakes in a linear fashion so that the car is brought to a relatively quick stop in an emergency without causing discomfort or injury to the passengers in the process.

Figure 3A:
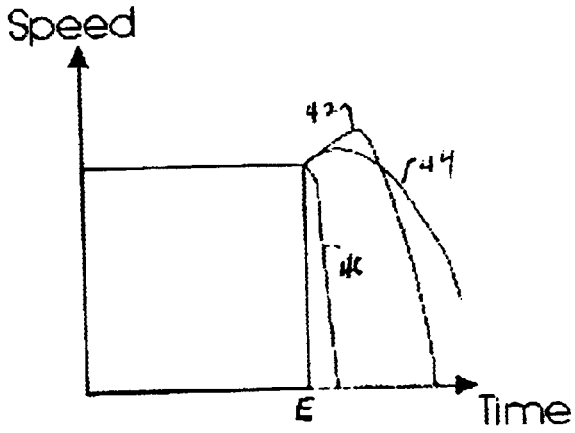

FIG. 3A is a graph of the speed of an elevator car over time. As is seen, normally the speed of the elevator car is constant as it moves to a desired floor. At a point in time "E," an emergency happens. Under prior art systems, when the brakes are applied following the emergency, the elevator car is slowed to a stop. However, the particular pattern of deceleration may vary depending on the conditions. In a first condition, the brake is applied and the cables remain in traction with the wheel so that maximum deceleration occurs, shown as curve 40. Thus, the car and its occupants are decelerated at a very high rate, which is generally considered to be uncomfortable.

A second possibility is that after braking the cables loose traction with the wheels so that the elevator actually accelerates as shown in curve 42. Once traction is reestablished, the car is quickly decelerated and eventually stopped. Thus, the passengers are subjected to an acceleration under freefall conditions and then suddenly decelerated at a high rate. This is also uncomfortable to the passengers.

A third possibility, shown as curve 44 is that the cables lose traction, leading to some acceleration followed by a slower rate of deceleration while friction occurs between the cables and sheave. While this arrangement is easier on the passengers, an inordinate amount of time is necessary to bring the car to a stop which may be both frightening and dangerous to the passengers.

Figure 3B:
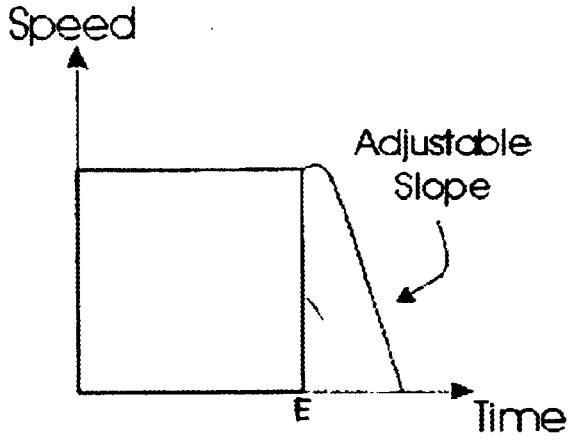

FIG. 3B shows the state of the elevator when using the present invention. When an emergency occurs at time "E" the brake is applied in a controlled fashion as described above. By doing so, the cables do not loose traction with the wheel so that little or no acceleration occurs. The brakes are then applied so as to bring the car to a stop at a rate which is not uncomfortable to the passengers and which does not require a great amount of time. As a result, the car is smoothly and safely brought to a halt during an emergency procedure.

Numerous additional modifications and variations of the present invention are possible in light of the above teachings. It is therefore to be understood that within the scope of the appended claims, the invention may be practiced otherwise and as specifically described herein.

What is claimed is:

1. A braking system for an elevator comprising:

a braking surface connected to a lifting apparatus for an elevator;

a brake for engaging said braking surface to stop said elevator;

a brake controller for applying an actuating signal to said brake, said brake controller acting in an emergency to actuate said brake to stop said elevator according to a desired deceleration profile by comparing said deceleration profile to a signal indicating car movement to determine a desirable speed change.

2. The system according to claim 1, wherein said signal indicating car movement is a car position signal.

3. The system according to claim 1, wherein said signal indicating car movement is a cable movement signal.

4. The system according to claim 3, wherein said brake controller further includes a speed regulator for receiving said desirable speed signal and a signal indicating motor rotation to determine a desired torque signal.

5. The system according to claim 4, wherein said brake controller further includes a brake model for receiving said torque signal and producing a desired current signal.

6. The system according to claim 5, wherein said brake further receives a signal indicating temperature of the brake.

7. The system according to claim 5, wherein said brake controller further includes a power amplifier for receiving said desired current signal and a brake current feedback signal to produce a brake actuation signal.

8. The system according to claim 1, wherein said elevator is caused to decelerate without causing lifting cables to loose traction with a driving sheave.

9. A method for braking an elevator car in an emergency comprising:

determining an emergency condition;

providing a braking signal from a brake controller to a braking device;

applying said braking device to slow said elevator according to a desired deceleration profiles, wherein said brake controller compares a decelerating profile with cable movement to produce a desired speed signal.

10. The method according to claim 9, wherein said braking occurs without loosing traction between lifting cables and a lifting sheave.

11. The method according to claim 9, wherein said brake controller includes a deceleration profile device, a speed regulator, a brake model and a power amplifier.

12. The method according to claim 9, wherein said speed signal is compared to a signal indicating motor rotation to produce a desired torque signal, which is input to a brake model to determine a desirable current signal.

13. A braking apparatus for stopping an elevator, comprising:

an elevator car;

a cable system connected to said elevator car;

a sheave around which said cables pass to lift said elevator car;

a motor for driving said sheave;

a braking surface;

a brake pad for engaging said braking surface to stop said sheave;

a brake driver for forcing said brake into engagement with said braking surface; and a brake controller for applying a signal to said brake driver to control the deceleration of said elevator car, wherein said brake controller includes a deceleration profile for comparing a desired deceleration curve with a signal indicating movement of said cable to produce a desired speed signal.

14. The apparatus according to claim 13, wherein said brake driver includes a spring for forcing said brake pad against said braking surface and an electrical coil acting in opposition to said spring when actuated.

15. The apparatus according to claim 13, wherein said braking surface is connected to said sheave.

16. The apparatus according to claims 13, further including a gear box between said motor and said sheave, and wherein said braking surface is mounted between said motor and gear box.

17. The apparatus according to claim 13, wherein said brake controller further includes a speed regulator for receiving an output from said deceleration profile and a signal indicating motor rotation to produce a desired torque signal.

18. The apparatus according to claim 17, wherein said brake controller includes a brake model for receiving said torque signal and producing a desired current signal based on a model of brake parameters.

19. The apparatus according to claim 18, further including a power amplifier for receiving said desired current signal and producing a signal to actuate said brake driver.

* * * * *

UNITED STATES PATENT AND TRADEMARK OFFICE

CERTIFICATE OF CORRECTION

PATENT NO. : 6,802,395 B1
DATED : October 12, 2004
INVENTOR(S) : Brad Helstrom et al.

It is certified that error appears in the above-identified patent and that said Letters Patent is hereby corrected as shown below:

Column 1,
Line 36, after "sensed", please insert:

--emergency, such as a heat sensor indicting a fire. Under these circumstances, the car is often stopped by a hard braking action.
Unfortunately, if the brake is applied suddenly to the sheave, or grooved wheel over which the cable passes, it is possible that the cable will loose traction with the wheel. If this happens, the sudden braking will cause the elevator to fall under gravity while being counteracted by friction between the cable and wheel to slowly bring the car to a stop. Thus, a passenger experiences a sudden acceleration and free fall feeling followed by a slow braking action. If the original braking does not cause the cable to loose traction with the wheel, the car is brought to a sudden stop at a high rate of deceleration which is also uncomfortable or dangerous to the passenger.
Accordingly, during emergencies, passenger comfort is sacrificed in an attempt to provide safety procedures.

Summary of the Invention

Accordingly, the present invention provides a system for braking an elevator car during an emergency situation.
The present invention further provides a system for a controlled deceleration of an elevator car during an emergency.
The present invention still further provides a braking system for an elevator with a controlled deceleration during an emergency situation.
The present invention also provides an apparatus for controlling the deceleration of an elevator car by controlling the voltage applied to the brake.
A still further object of this invention is to provide a method for controlling the deceleration of an elevator car in an emergency.
Briefly, this is achieved by providing a brake controller which controls the brake voltage in accordance with a desired deceleration profile, taking into account feedback from the brake current, temperature, motor rotation and cable movement.--

UNITED STATES PATENT AND TRADEMARK OFFICE

CERTIFICATE OF CORRECTION

PATENT NO. : 6,802,395 B1
DATED : October 12, 2004
INVENTOR(S) : Brad Helstrom et al.

It is certified that error appears in the above-identified patent and that said Letters Patent is hereby corrected as shown below:

Column 4,
Line 64, "profiles" should be -- profile --; and

Column 6,
Line 9, "claims" should be -- claim --.

Signed and Sealed this

Seventeenth Day of May, 2005

JON W. DUDAS
*Director of the United States Patent and Trademark Office*